US010260238B2

(12) United States Patent
French

(10) Patent No.: US 10,260,238 B2
(45) Date of Patent: Apr. 16, 2019

(54) GUTTER MOUNTING ADAPTER

(71) Applicant: Jerry Ray French, Seaside, OR (US)

(72) Inventor: Jerry Ray French, Seaside, OR (US)

( * ) Notice: Subject to any disclaimer, the term of this patent is extended or adjusted under 35 U.S.C. 154(b) by 0 days.

(21) Appl. No.: 15/365,065

(22) Filed: Nov. 30, 2016

(65) Prior Publication Data

US 2018/0148933 A1 May 31, 2018

(51) Int. Cl.

| | |
|---|---|
| ***E04B 1/38*** | (2006.01) |
| ***E04D 13/064*** | (2006.01) |
| ***E04D 13/072*** | (2006.01) |

(52) U.S. Cl.

CPC ..... *E04D 13/0645* (2013.01); *E04D 13/0722* (2013.01)

(58) Field of Classification Search

CPC ..... E04D 13/0645; E04D 13/0722
USPC ..... 52/698, 11, 13, 14
See application file for complete search history.

(56) References Cited

U.S. PATENT DOCUMENTS

| | | | | | |
|---|---|---|---|---|---|
| 2,777,405 | A * | 1/1957 | Ager | E04D 13/0645 | 52/16 |
| 4,727,689 | A * | 3/1988 | Bosler | E04D 13/076 | 52/11 |
| 4,956,948 | A * | 9/1990 | Hart | E04D 13/08 | 210/162 |
| 5,360,284 | A * | 11/1994 | Allard | E03F 5/041 | 404/2 |
| 5,526,612 | A * | 6/1996 | Wade | E04D 13/0645 | 210/474 |
| D425,182 | S * | 5/2000 | Vargas | D23/260 | |
| 6,537,446 | B1 * | 3/2003 | Sanguinetti | E03F 5/0404 | 210/163 |
| D475,440 | S * | 6/2003 | Sawyer | D23/267 | |
| D482,433 | S * | 11/2003 | Sawyer | D23/267 | |
| D589,599 | S * | 3/2009 | Castrillo | D23/267 | |
| 8,286,390 | B2 * | 10/2012 | Leahy | E04D 13/0645 | 52/11 |
| D732,147 | S * | 6/2015 | French | D23/267 | |
| 2005/0086883 | A1 * | 4/2005 | Wade | E04D 13/0645 | 52/302.1 |

* cited by examiner

*Primary Examiner* — Basil S Katcheves
(74) *Attorney, Agent, or Firm* — Chernoff, Vilhaure LLP

(57) ABSTRACT

A gutter adapter.

8 Claims, 4 Drawing Sheets

GUTTER MOUNTING ADAPTER

CROSS REFERENCE TO RELATED APPLICATIONS

None

BACKGROUND

The subject matter of this application generally relates to gutters and more particularly to an adapter between a gutter and a downspout.

Rain gutters around the perimeter of the roof of a house commonly become clogged or jammed with various debris including leaves, needles, shingle sand, and other materials that fall onto the gutter. The accumulation of such debris impairs the ability of the gutter to channel water, thus gutters typically must be cleaned frequently. To address this issue, gutter debris barrier systems, or gutter guards, have been introduced to prevent debris from collecting within the gutter. The goal of gutter guards is to prevent debris from entering the gutter while still maintaining water flow through the gutter guard and into the gutter, such that water is not dripping down the outside of the gutter, and ultimately the building.

Typically a gutter barrier system will include a screen over the gutter with multiple apertures through or around the screen. The size of the apertures is selected to balance the need for a sufficient flow of water into the gutter against the need to prevent debris from flowing through the apertures. Thus, many such barrier systems will still allow debris to fall into the gutter.

One particular place at which debris typically accumulates in a gutter is at the opening in the bottom of the gutter, through which water pours into the downspout. Specifically, pine needles and other such debris will typically catch on edges surrounding the opening, and debris will accumulate over time.

What is desired, therefore, is an improved apparatus that prevents the accumulation of debris in a gutter.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

As noted previously, debris in a gutter tends to accumulate around an opening where water is removed from the gutter so that it can flow through a downspout. More particularly, gutter adapters typically are connected at one end to the bottom of a gutter, and are connected at the other end to a tubular downspout. U.S. Pat. No. D732,147 broadly depicts such a gutter adapter, capable of being installed in a gutter, and which is designed to minimize any edges at the interface between the adapter and the gutter, upon which debris may accumulate.

However, the gutter shown in U.S. Pat. No. D732,147 is often difficult to retrofit into existing gutters because the back surface of the gutter adapter cannot be secured to the gutter from behind, as the building is in the way, and it is difficult to reach down into the gutter to secure the gutter to the back surface of the adapter from the front.

Figure 1:
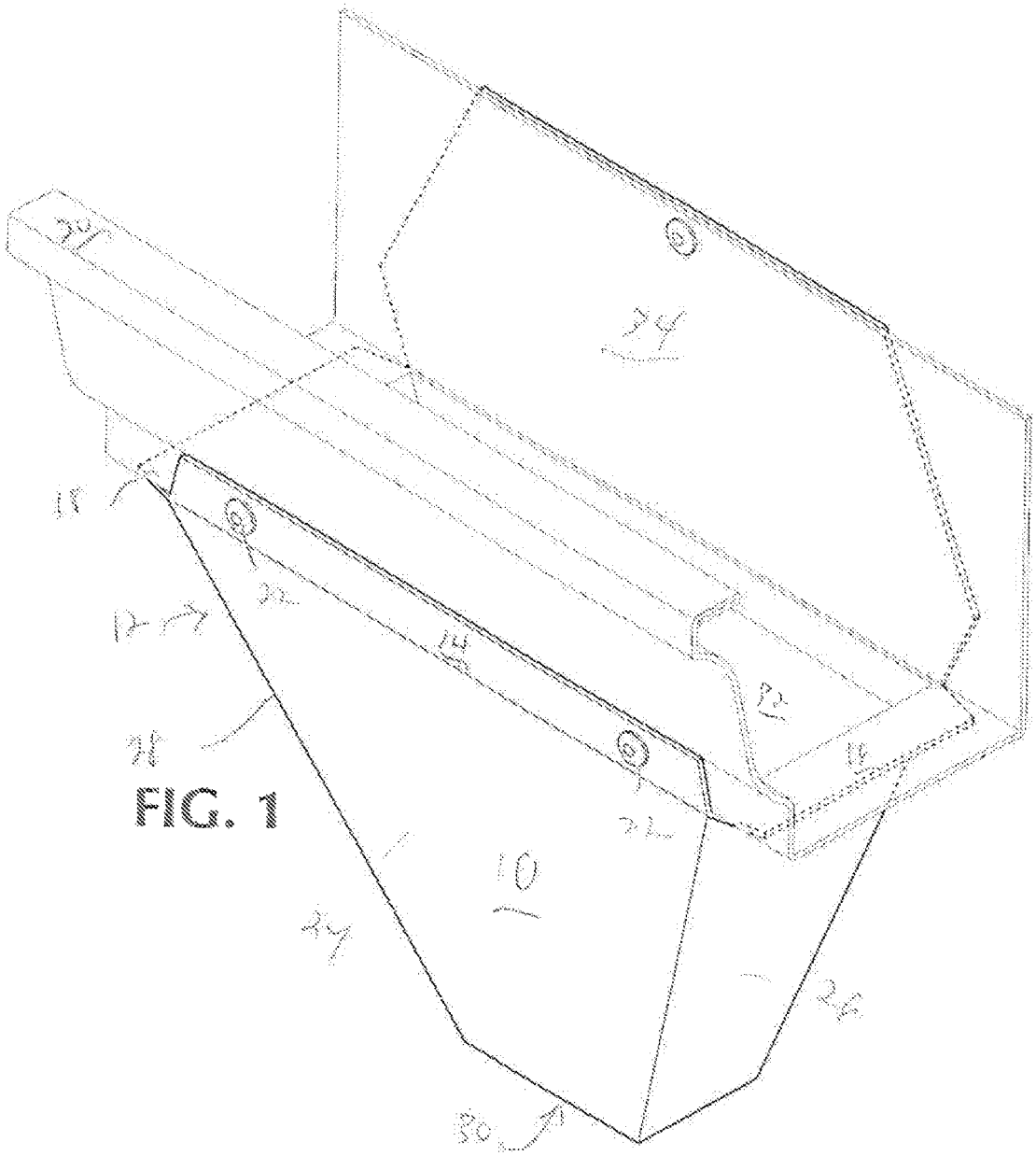
FIG. 1 shows a gutter mounting adapter between a gutter and a downspout, attached to a gutter.
Figure 2:
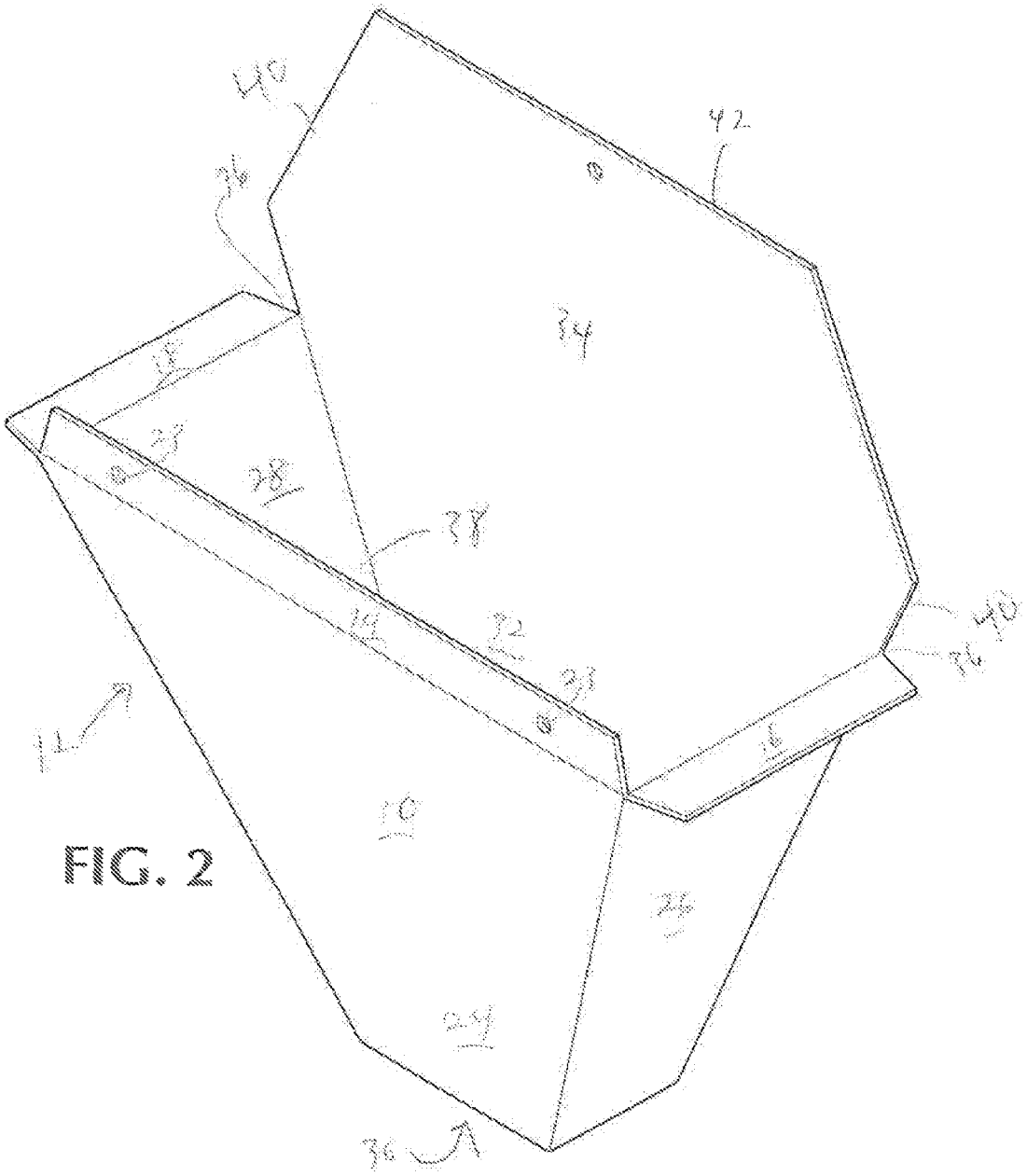
FIG. 2 shows a perspective view of the gutter mounting adapter of FIG. 1.

Referring to FIGS. 1 and 2, an improved gutter adapter 10 may comprise a box-shaped enclosure 12 having three tabs 14, 16, and 18 on the upper front and upper side surfaces of the enclosure 12, respectively. The front tab 14 may be secured to a gutter 20 by rivets 22, or any other appropriate fastening device, which are inserted through apertures 23 in the tab 14. The inner tabs 16 and 18, conversely, may be positioned to either side of an opening in the bottom of the gutter 20, so that the edges of that opening may be folded down into the enclosure 12, so that there are virtually no edges upon which debris may accumulate. The gutter 10 preferably has inwardly-sloping surfaces 24, 26, and 28 that converge to a lower opening 30 selectively engageable with a downspout (not shown).

Preferably, the gutter adapter 10 has a rear side 32 that is not inwardly sloping so that it mounts roughly parallel with the wall of the building to which the gutter adapter is secured. Those of ordinary skill in the art will realize, however, that although the non-sloping feature of the rear side 32 is aesthetically more pleasing, other embodiments may have an inwardly sloping rear side 32.

To facilitate the attachment of the gutter adapter 10 to a gutter 20, the rear wall 32 preferably has an upper portion 34 that extends a significant distance higher than the front and side faces 24, 26, and 28. Preferably, the upper portion 34 is sized to extend to the full height of the gutter 20, when attached. In some embodiments, the upper portion 34 extends at least one inch above the crease 36 of the tabs 16 and 18. In some embodiments, the upper portion 34 extends at least two inches above the crease 36 of the tabs 16 and 18. In other embodiments, the upper portion 34 extends at least three inches above the crease 36 of the tabs 16 and 18. In some embodiments, the upper portion 34 extends at least four inches above the crease 36 of the tabs 16 and 18.

In some embodiments, the upper portion 34 extends at least one inch above the top edge 38 of the tab 14. In some embodiments, the upper portion 34 extends at least two inches above the top edge 38 of the tab 14. In other embodiments, the upper portion 34 extends at least three inches above the top edge 38 of the tab 14. In some embodiments, the upper portion 34 extends at least four inches above the top edge 38 of the tab 14.

In some embodiments, the lateral edges of the upper portion 34 may initially slant laterally outwardly, following the slope of the side surfaces 26 and 28, before angling inwardly to the top edge 42. In other embodiments, the lateral edges of the upper portion 34 may simply slant laterally outwardly following the slope of the side surfaces 26 and 28 until they reach the top edge 42.

Figure 3:
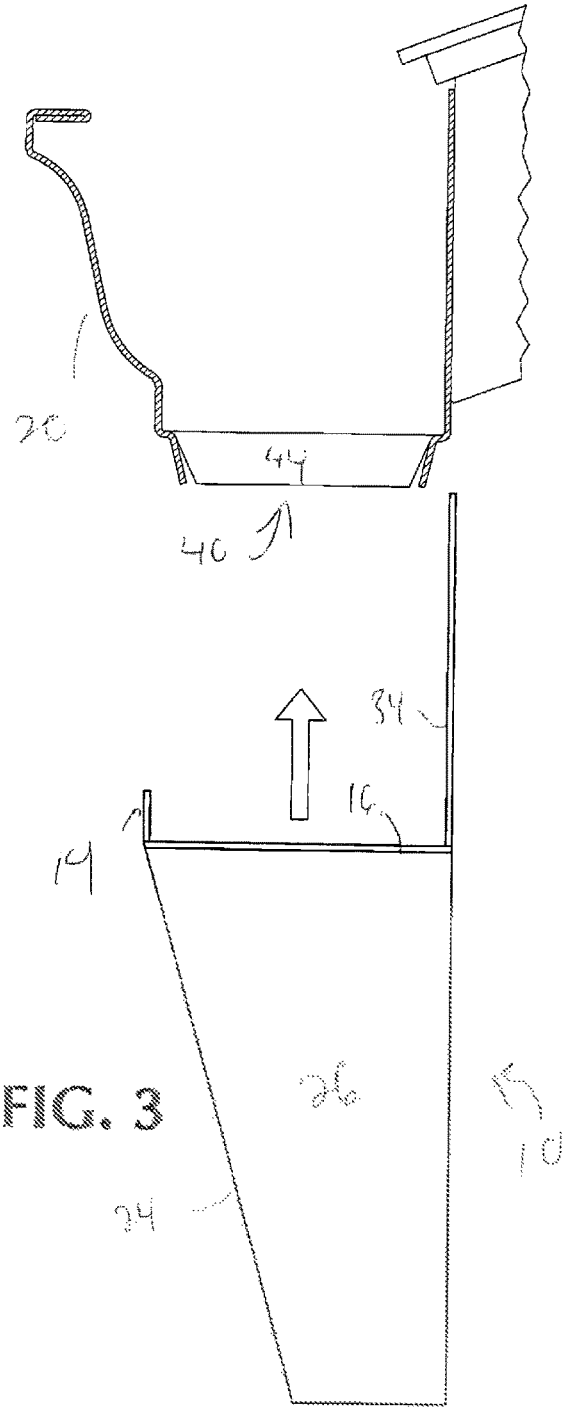
FIG. 3 shows a side view of the gutter mounting adapter of FIG. 2 as it is about to be installed to a gutter.
Figure 4:
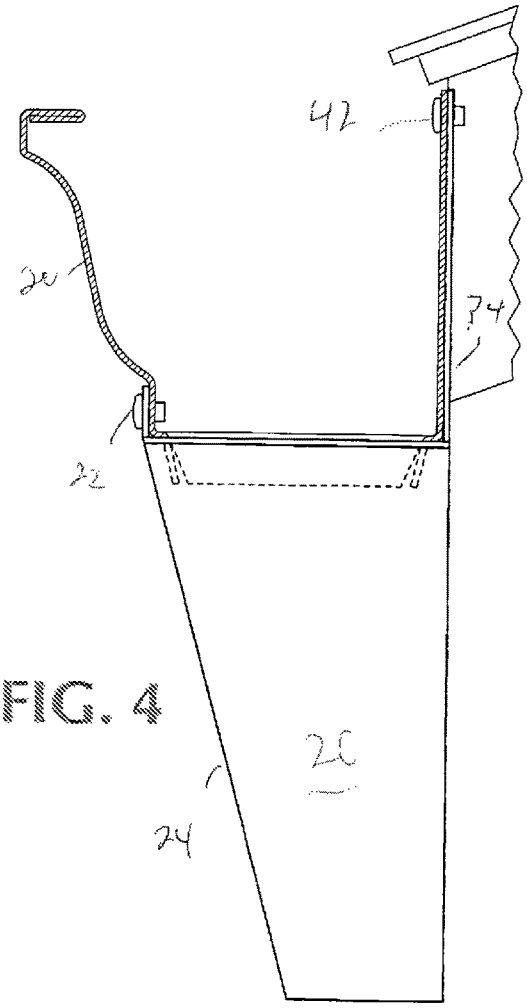
FIG. 4 shows a side view of the gutter mounting adapter of FIG. 2 after it is installed to a gutter.

FIGS. 3 and 4 show the ease with which the gutter adapter 10 is installed on a gutter. Initially, the gutter adapter 10 is positioned beneath the gutter 20, and below opening 40 in the gutter's bottom. The gutter adapter 10 is thereafter brought up into position, with the upper portion 34 extending between the narrow space between the gutter 20 and the house to which the gutter 20 is attached. Once in position, the upper portion 34 may be secured to the gutter 20 via a rivet 42, and the front tab 14 may be secured to the gutter 20 via rivets 22. The interior flanged portions 44 of the bottom of the gutter 20 may then be bent down into the gutter adapter 10, if desired.

Figure 5:
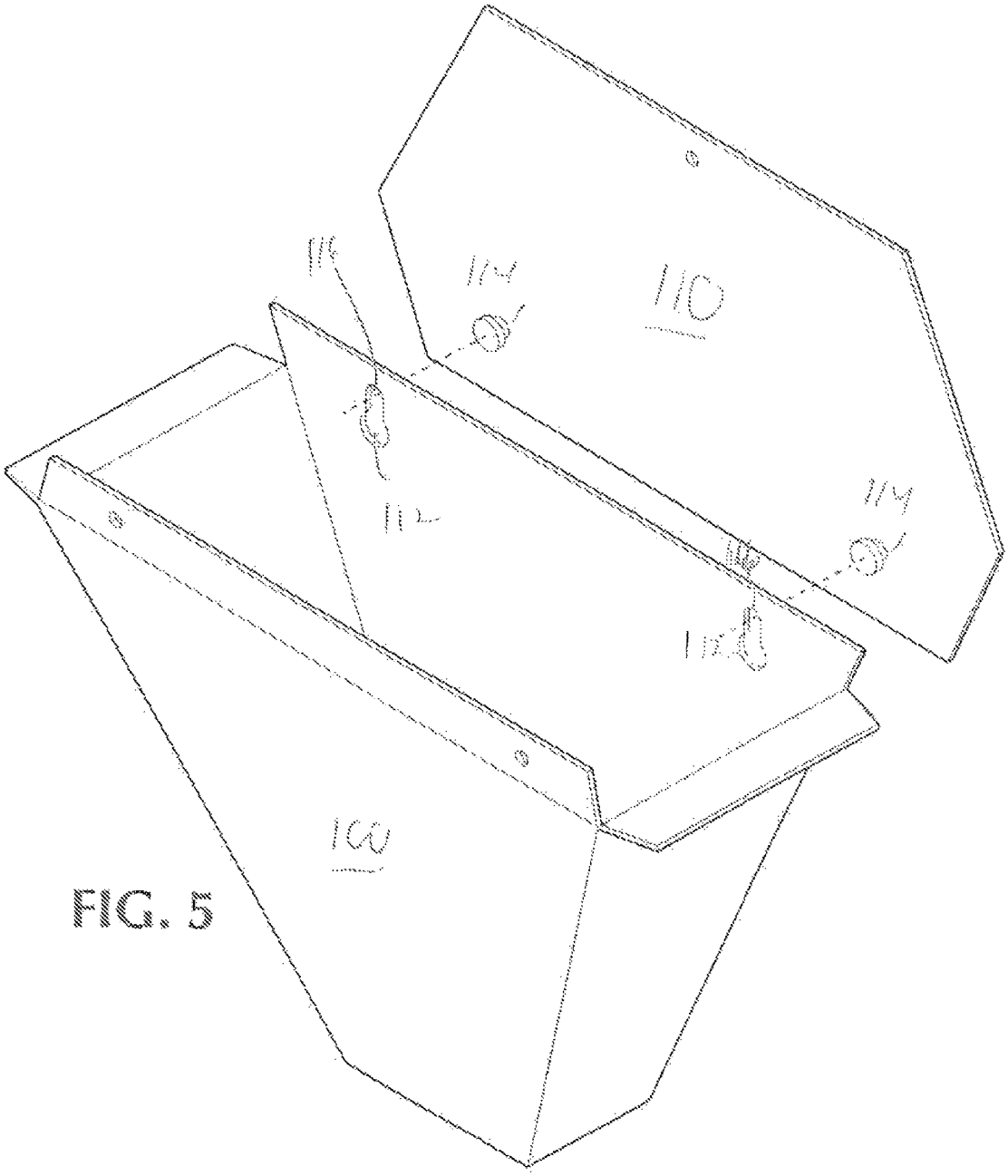
FIG. 5 shows an alternate gutter mounting adapter comprising a base adapter and a mounting plate.

FIG. 5 shows an alternate embodiment where a gutter adapter comprises a lower enclosure 100 and a rear plate 110 selectively attachable to the lower enclosure 110. Specifically, the rear plate 114 preferably includes outwardly flanged pins 114 that may be selectively inserted into notches 112, and locked into place when the flanges of the pins 114 slide into neck portions 116 of the notches 112. Those of ordinary skill in the art will appreciate that other fasteners may be used to connect the lower enclosure 100 with the rear plate 110. For example, the two pieces may simply be riveted together prior to installation. Similarly, those of ordinary skill in the art will appreciate that, although the notches 112 are depicted in FIG. 5 with the neck portion 116 at the top of the notches, other embodiments may place the neck portion 116 at the bottom of the notches 112. The assembly shown in FIG. 5 may be installed by first attaching the lower enclosure 100 to the rear plate 100, before installing the attached pieces to a gutter, or alternately may be installed by first attaching the rear plate 110 to the gutter, then attaching the lower enclosure 100 to the rear plate.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A gutter adapter comprising:

(a) an enclosure comprising a front wall, a rear wall, and two opposed lateral walls together defining an upper opening and a lower opening smaller than the upper opening, the front wall inwardly inclined from the upper opening to the lower opening, the enclosure having a front tab extending above the upper opening by a first distance; and (b) a back mounting plate selectively attachable to a rear surface of a gutter and selectively attachable to and detachable from the enclosure such that when attached to the enclosure, the back mounting plate is flush with and extends parallel to at least one surface of the back wall, and extends above the upper opening by a second distance, the second distance greater than the first distance.

2. The gutter adapter of claim 1 where the second distance is greater than the first distance by at least one inch.

3. The gutter adapter of claim 1 where the second distance is greater than the first distance by at least two inches.

4. The gutter adapter of claim 1 where the second distance is greater than the first distance by at least four inches.

5. The gutter adapter of claim 1 where the second distance is such that the back mounting plate is does not extend above the rear surface of the gutter when the gutter adapter is attached to the gutter.

6. The gutter adapter of claim 1 where the back mounting plate comprises a protrusion selectively horizontally insertable within an aperture defined in the back wall of the enclosure.

7. The gutter adapter of claim 6 where the protrusion and aperture jointly form a latch moveable from a first position that allows retraction of the protrusion from the aperture to a second position that prevents retraction of the protrusion from the aperture.

8. The gutter adapter of claim 7 where the rear wall is not inwardly sloping.

* * * * *